United States Patent [19]

Foster

[11] 4,313,112

[45] Jan. 26, 1982

[54] COMPUTER WORK STATION ASSEMBLY AND MOUNTING APPARATUS THEREFOR

[76] Inventor: Daniel F. Foster, 7160 S. Vine Cir. E., Littleton, Colo. 80122

[21] Appl. No.: 104,385

[22] Filed: Dec. 17, 1979

[51] Int. Cl.[3] ..... G09G 1/00

[52] U.S. Cl. ..... 340/700; 248/442.2; 248/639; 312/196; 340/365 R; 400/682

[58] Field of Search ..... 340/711, 700, 709, 710, 340/717, 365 R; D6/184, 132, 138, 155, 156; D18/6, 8, 11, 12; D10/15; 312/196, 235 R, 235 A, 281, 278, 279; 248/441 R, 441 B, 639, 442.2; D14/42–44; 434/432; 400/691, 682; 313/482

[56] References Cited

U.S. PATENT DOCUMENTS

| | | | |
|---|---|---|---|
| D. 228,460 | 9/1973 | Conway | D14/43 |
| D. 231,103 | 4/1974 | Moeckl | D14/44 |
| D. 238,282 | 12/1975 | Shawen et al. | D18/6 |
| D. 252,301 | 7/1979 | McCarty | 340/711 |
| D. 253,981 | 1/1980 | Fritz et al. | D6/184 |
| D. 255,193 | 6/1980 | Heitz | D6/184 |
| 2,115,497 | 4/1938 | Mintz | 434/432 |
| 3,641,266 | 2/1972 | Stults et al. | 340/717 |
| 3,732,557 | 5/1973 | Evans et al. | 340/710 |
| 3,778,125 | 12/73 | Gutmann, Jr., Et. Al | 312/272.5 |
| 3,822,545 | 7/1974 | Catto et al. | D10/15 |
| 3,847,461 | 11/1974 | Moeckl | 312/281 |
| 4,141,001 | 2/1979 | Suzuki et al. | 340/711 |
| 4,208,081 | 6/1980 | Kekas et al. | 400/682 |

FOREIGN PATENT DOCUMENTS

| | | | |
|---|---|---|---|
| 2847135 | 5/1980 | Fed. Rep. of Germany | 340/700 |

*Primary Examiner*—Marshall M. Curtis
*Attorney, Agent, or Firm*—Larson and Taylor

[57] ABSTRACT

A computer work station assembly comprises a display having a viewing screen, a display actuator, and mounting apparatus for supporting copy material and at least the display with respect to a work surface such that the display actuator, the copy material, and the display may be disposed in line with the viewing screen of the display disposed relatively above and longitudinally spaced from the display actuator so as to minimize reflections on the viewing screen which would distract a work station operator and so as to position the display viewing screen at a predetermined focal distance from a work station operator.

21 Claims, 8 Drawing Figures

COMPUTER WORK STATION ASSEMBLY AND MOUNTING APPARATUS THEREFOR

FIELD OF THE INVENTION

The present invention relates in general to computer display and keyboard work station assemblies, and in particular to copy holding mounting apparatus for such assemblies.

BACKGROUND OF THE INVENTION

As a result of recent advances in computer technology, including the advent of microprocessor computers, the use of modular cathode-ray-tube (CRT) display and keyboard work station assemblies has proliferated. In conventional assemblies, the keyboard is disposed immediately in front of the display with the screen of the display positioned immediately above the rear of the keyboard. Such assemblies suffer from two major disadvantages.

First, the input material or copy from which an operator works must be placed to one side of the keyboard-/display assembly. Consequently, operators must repeatedly move their heads back and forth from the copy to the CRT screen when entering data for actuation of the display. In such systems, operator focus time is slowed with each "read" since the combined head and eye movement required to switch from the copy material to the CRT display screen encompasses a twin axis. This causes production to be slowed, the incidence of errors to be increased, and fatigue of the operators to be accelerated.

Second, in conventional assemblies, the CRT screen is too low and too close to the operator. The conventional CRT screen placement permits excessive reflections on the screen surface, which distracts operators, and places the screen in an intermediate focal distance from the eyes of an operator which is not compatible with the vision requirements of many people and which is particularly irritating to those people who wear bifocal glasses.

SUMMARY OF THE INVENTION

These and other disadvantages of the prior art are overcome by mounting apparatus for a work station assembly constructed in accordance with the present invention, which comprises support apparatus for supporting copy material and at least the display with respect to a work surface such that the keyboard, or display actuator, the display, and the copy material may be disposed in line, with the display viewing screen disposed relatively above the longitudinally spaced from the display actuator so as to minimize reflections on the viewing screen as viewed by a work station operator and so as to position the viewing screen at a predetermined focal distance from a work station operator.

In accordance with a further aspect of the present invention, support apparatus is provided for supporting copy material mounted thereon such that the copy material is disposed intermediate the display and display actuator and such that the copy material is positioned relatively higher than the display actuating means and relatively lower than the viewing screen, and at an inclined attitude with respect to a work station operator.

In accordance with a still further aspect of the present invention, support apparatus is also provided for supporting the display actuator at a level below the level of the work surface which is at a predetermined height relative to a work station operator so as to facilitate operation of the display actuator.

Advantageously, the support apparatus comprises at least one platform defining a horizontal surface for each of the display and display actuator devices which is supported by the support apparatus, and first and second vertical positioning surfaces against which a rear surface of the display actuator and a front surface of the display, respectively, abut when the display and display actuator are operatively mounted on the mounting apparatus.

Other features and advantages of the invention will be set forth in, or apparent from, the detailed description of preferred embodiments found hereinbelow.

DETAILED DESCRIPTION OF PREFERRED EMBODIMENTS

Figure 1:
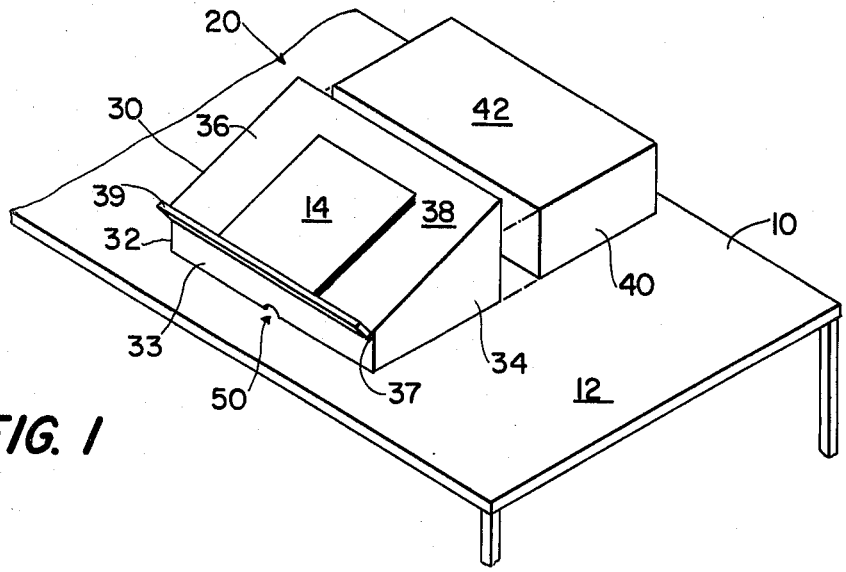
FIG. 1 is a front perspective view of a first embodiment of mounting apparatus constructed in accordance with the present invention.
Figure 2:
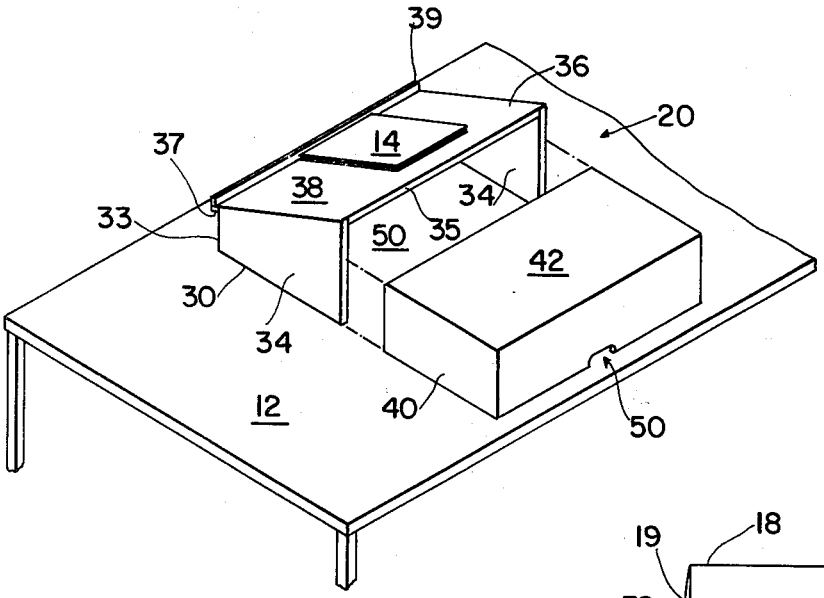
FIG. 2 is a rear perspective view of the embodiment illustrated in FIG. 1.
Figure 3:
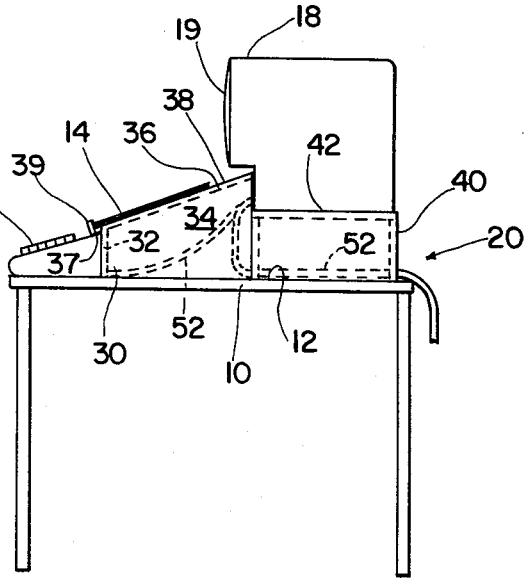
FIG. 3 is a side elevation view of the embodiment illustrated in FIG. 1 showing a display and display actuator disposed in operative relationship therewith.

Referring to FIGS. 1–3, a first embodiment of mounting stand constructed in accordance with the present invention will now be described. The stand, generally denoted 20, is shown mounted on a conventional table 10 which defines a work surface 12.

Stand 20 generally comprises a first portion or platform 30 mounted on work surface 12 and having a copy support surface for supporting copy material 14, which typically is in the form of work sheets, notebooks and the like, and contains input data to be fed into a conventional computer or other device (not shown) via a conventional keyboard 16 in order to actuate a conventional display 18. Stand 20 further generally comprises a second portion or platform 40 mounted on work surface 12 in line with and adjacent to platform 30 and having a further support surface for supporting display 18 in a predetermined spatial relationship with respect to keyboard 16 and an operator. Platforms 30 and 40 advantageously are separable, modular units, as shown, for use with model of keyboard 16 and display 18 which are "hardwired" together, to facilitate shipping and storage, and to allow the use together of units of different dimensions such that apparatus may be custom fit to different types of keyboards 16, displays 18, tables 10, and operators. However, it will be appreciated by those of ordinary skill in the art that platforms 30 and 40 also are advantageously constructed as an integral one-piece unit for use with plug-compatible models of keyboard 16 and display 18.

Platform 30 advantageously comprises a vertically oriented front region which may include panel 32 defining a front positioning surface 33 connected to two vertically oriented trapezoidal side panels 34 having inclined upper edges, and a top panel 36 forming the copy support surface and connected to the upper edges of panels 32 and 34 so as to define an inclined support surface 38. As shown, top panel 36 advantageously extends beyond front panel 32 to define an overhanging portion 37, and is provided with an upwardly projecting lip or flange 39 against which copy material 14 abuts when mounted on platform 30. To allow selective longitudinal positioning of copy material 14 relatively closer to or further away from keyboard 16 and an operator, flange 39 advantageously is slidably mounted on top panel 36 in a conventional manner, such as by means (not shown) of bolts which project from flange 39 and pass through longitudinal slots in panel 36 and which cooperate with clamping nuts disposed on the underside of panel 36 to releasably clamp flange 39 in a desired position.

Front panel 32 advantageously is of sufficient height to allow keyboard 16 to be disposed on work surface 12 with respect to platform 30 such that the rear surface of keyboard 16 abuts positioning surface 33 and overhanging portion 37 of top panel 36 clears the top of keyboard 16. Alternatively, in order to simplify construction, top panel 36 is configured such that the front edge thereof is coterminous with the top edge of front panel 32 and front panel 32 is dimensioned so as to be slightly shorter in height than the rear surface of keyboard 16. In this embodiment of platform 30 (not shown), the rear surface of keyboard 16 acts as a stop for copy material 14 when keyboard 16 is operatively positioned with respect to mounting apparatus 20, and thus top panel 36 of platform 30 advantageously is not provided with flange 39 as in the embodiment illustrated in FIGS. 1–3.

Platform 30 advantageously is further configured so as to define a back region which may include a vertically oriented rear positioning surface 35 against which display 18 abuts when display 18 is operatively mounted on platform 40. Surface 35 serves, in cooperation with surface 33, to position display 18 such that the viewing screen 19 thereof is a predetermined longitudinal distance from keyboard 16, and thus is at a predetermined focal length from an operator conventionally positioned with respect to keyboard 16. Surface 35 can be defined by the rear edge of top panel 36, as shown, or can be defined by a separate panel or the like (not shown), which advantageously can be slidably mounted to platform 30 in a conventional manner (not shown) such that the distance between surfaces 33 and 35 can be varied to accomodate different operators. As will be appreciated by those of ordinary skill in the art, front positioning surface 33 advantageously also is defined by a separate panel (not shown) rather than by front panel 32, to allow positioning of keyboard 16 relative to an operator independently of the postioning of display 18.

Top panel 36 of platform 30 preferably is dimensioned such that support surface 38 is large enough to accomodate standard sizes of copy material 14. Platform 30 is preferably further configured such that the angle of inclination of support surface 38 is sufficient to facilitate visual inspection by an operator of copy material 14 mounted thereon, and to position the rear edge of panel 36 longitudinally of surface 33 so as to define surface 35, or so as not to interfere with the operation of surface 35 in embodiments of mounting apparatus 20 which utilize other structure to define surface 35.

Advantageously, top panel 36 is also pivotably mounted to front panel 32 and lateral panels 34 in a conventional manner (not shown) such that the angle of inclination of surface 38 may be adjusted to accomodate individual operators.

Platform 40 advantageously is of any conventional construction which defines a horizontal planar further support surface 42 which is disposed at a predetermined height above work surface 12 such that the viewing screen 19 of a display 18 mounted thereon is centered with respect to the line of sight of an operator. In the case of an IBM Model No. 5251 display 18 and a work surface 12 disposed at the recommended typing height of approximately 26–27 inches (66–68.6 cm) above the floor, a platform 40 having a support surface 42 disposed approximately six to seven inches (15.2–17.8 cm) above work surface 12 has proven satisfactory in minimizing reflections on viewing screen 19 which are distracting to an operator positioned for conventional seated operation of keyboard 16.

As will be appreciated by those of ordinary skill in the art, platform 40 advantageously is sectioned into upper and lower sections and the sections joined in a conventional manner (not shown) to allow vertical displacement of the upper platform section with respect to the lower platform section, and thereby allow the height of support surface 42 to be adjusted to accomodate individual operators.

Mounting apparatus 20 preferably is further provided as shown with openings 50 disposed in selected vertically oriented panels through which pass the cables 52 which electrically connect conventional models of keyboard 16 to conventional models of CRT display 18 and which connect display 18 to the associated computer and/or power source (not shown). For models of keyboard 16 having a cable 52 connected at the rear thereof, an opening 50 in front panel 32, as shown, is advantageous. For models of display 18 having a cable 52 connected at the front thereof, an opening 50 defined by the absence of a rear panel for platform 30, as shown, is advantageous. Preferably, in embodiments of mounting apparatus 20 in which platforms 30 and 40 are separable units, openings 50 constitute notches or slots as shown, formed in the bottom edges of platform 30 and which communicate with work surface 12 such that models of keyboard 16 and display 18 having cable 52 "hardwired" or permanently attached may be operatively disposed with respect to mounting apparatus 20 without disconnecting cables 52.

Figure 4:
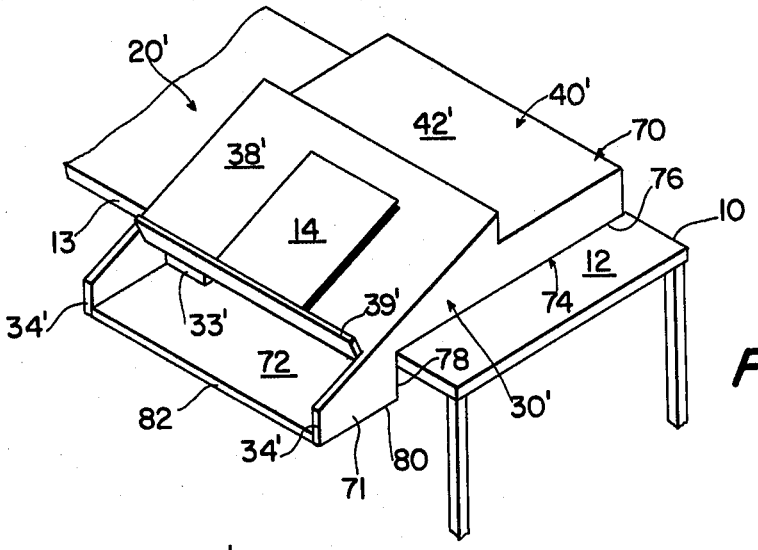
FIG. 4 is a front perspective view of a second embodiment of mounting apparatus constructed in accordance with the present invention.
Figure 5:
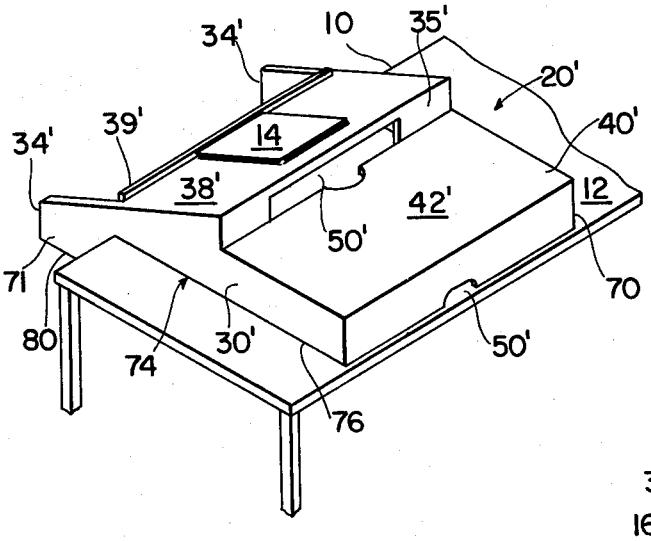
FIG. 5 is a rear perspective view of the embodiment illustrated in FIG. 4.
Figure 6:
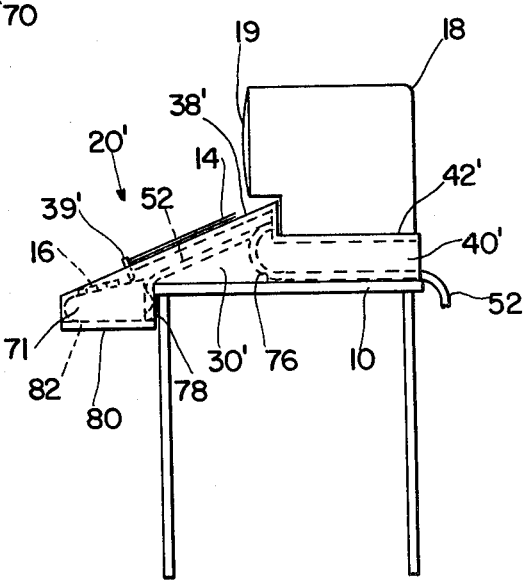
FIG. 6 is a side elevation view of the embodiment illustrated in FIG. 4 showing a display and display actuator disposed in operative relationship therewith.

Referring now to FIGS. 4–6, a second embodiment of mounting apparatus constructed in accordance with the present invention will now be described. The embodiment of FIGS. 4–6 is similar to the embodiment of FIGS. 1–3, and like elements have been denoted by like reference numerals with primes attached. For clarity of description, only those features which differ in the two embodiments will be described hereinbelow.

Mounting apparatus 20' is particularly adapted for use with a work surface 12 which is disposed at a level which is higher than that at which keyboard 16 can be conveniently operated by an operator, and advantageously comprises, as shown, a unitary platform 70 having a first platform section 71 defining a horizontal support surface 72 for supporting keyboard 16, a second platform section 40' defining a horizontal support surface 42' for supporting display 18 in a predetermined spatial relationship with respect to keyboard 16 and an operator, and a third platform section 30' defining an inclined support surface 38' for supporting copy material 14.

As shown, platform 70 is preferably further configured such that the bottom or base 74 thereof has a step-like configuration comprising a horizontal rear section 76 which engages work surface 12, a horizontal front section 80 which defines support surface 72, and a vertical section 78 which connects front section 80 to rear section 76, which defines vertical positioning surface 33', and which abuts the edge 13 of work surface 12 when platform 70 is operatively disposed on work surface 12. Front base section 80 extends outwardly from work surface 12 at a predetermined level therebelow so as to position support surface 72 at a predetermined height relative to an operator which facilitates operation of keyboard 16 thereby. In accordance with recommended typing practices, support surface 72 advantageously is disposed approximately 26–27 inches (66–68.6 cm) above the floor on which work surface 12 is supported.

Advantageously, front base section 80 comprises a panel 82 defining support surface 72 which extends transversely between the lateral panels 34' of platform 70 and is slidably mounted thereto in a conventional manner (not shown) such that panel 82 may be displaced vertically so as to adjust the relative height of surface 72.

Preferably, vertical section 78 defines a slot or opening 50' through which the cable 52 electrical connecting keyboard 16 to display 18 passes.

Figure 7:
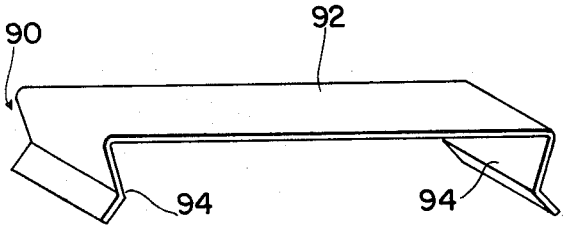
FIG. 7 is a front perspective view of a guide member adapted for use with mounting apparatus constructed in accordance with the present invention.
Figure 8:
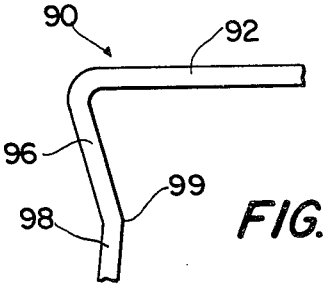
FIG. 8 is a front elevation view of a portion of the member illustrated in FIG. 7.

Referring to FIG. 1 and FIGS. 7–8 mounting apparatus constructed in accordance with the present invention advantageously further comprises a guide member 90 releaseably and slidably mounted thereon for securing copy material 14 to inclined support surface 38 and for facilitating reading of the text of copy material 14 supported on surface 38. Guide member 90 preferably is made of a clear plastic material such as acrylic or the like so that an operator can reference lines of text on copy material 14 above and below the line being read. As shown, guide member 90 preferably comprises an elongate band 92 which extends transversely across and parallel to support surface 38, and depending lateral legs 94 which straddle platform 30 and engage lateral panels 34 thereof. Preferably at least one of the legs 94 is flexibly joined to band 92 such that the at least one leg 94 must be flexed outwardly with respect to the other leg 94 under tension in order for legs 94 to operatively engage platform lateral panels 34. Preferably, legs 94 are angled or bent such that base portions 96 thereof are inclined inwardly with respect to each other and the distal portions 98 are inclined outwardly away from each other, and substantially only the vertex portions 99 engage lateral panels 34. Further, at least vertex portions 99 are spaced apart from each other in the unflexed condition of legs 94 by a distance which is less than the distance between lateral panels 34.

It will be appreciated from the foregoing description by those of ordinary skill in the art that mounting apparatus constructed in accordance with the present invention, and a work station assembly comprising such apparatus, aligns keyboard 16, the associated display 18, and the copy material 14 containing the data to be used to actuate display 18 in an optimum relationship with respect to each other and with respect to an operator. Transcribing time and errors are decreased, and productivity is thus increased, because shifts of focus by an operator are minimized, and because display 18 and copy material 14 are disposed at optimal focal distances from an operator.

Although the invention has been described with respect to exemplary embodiments thereof, it will be understood that variations and modifications can be effected in the embodiments without departing from the scope or spirit of the invention.

I claim:

1. A mounting stand for a cathode ray tube display screen and keyboard work station comprising:

a first portion having a front region located in a vertical plane and terminating at a first height, a back region generally parallel to the front region and extending up to a height greater than the height of the front region, a copy support surface starting from the top of the front region and inclined upwardly to the top of the back region to define the copy support surface for holding copy material, a second portion comprising means defining a further support surface starting adjacent the said back region of the first portion and at a height less than the said second height and extending generally horizontally in a direction away from the first portion for removably holding a separate cathode ray tube device thereon such that its display screen is above said second height, said front region, copy support surface, back region and further support surface being generally aligned, front to back, such that for an operator suitably positioned to operate a keyboard located immediately in front of the front region, a display screen mounted on the further support surface will be at eye level with the copy support surface located in line between the keyboard and the display screen.

2. A mounting stand according to claim 1, said first and second portion being formed as a single, integral piece.

3. A mounting stand according to claim 1, said first and second portions each being a separate piece.

4. A mounting stand for a cathode ray tube display screen and keyboard work station comprising:

a first portion having a front region located in a vertical plane and terminating at a first height, a back region generally parallel to the front region and extending up to a height greater than the height of the front region, a copy support surface starting from the top of the front region and inclined upwardly to the top of the back region to define the copy support surface for holding copy material, a second portion comprising means for defining a further support surface starting adjacent the said back region of the first portion and at a height less than the said second height and extending generally horizontally in a direction away from the first portion for removably holding a separate cathode ray tube device thereon such that its display screen is above said second height, and including a third portion defining a front support surface starting from the bottom of said front region and extending generally horizontally in a direction away from the said first portion so as to define the front support surface for the keyboard, said front region, copy support surface, back region and further support surface being generally aligned, front to back, such that for an operator suitably positioned to operate a keyboard located on said front support surface, a display screen mounted on the further support surface will be at eye level with the copy support surface located in line between the keyboard and the screen.

5. A mounting stand according to claim 4, wherein the bottom of the mounting stand includes a step between the said front region and the said back region, the front part of the bottom of the mounting stand forward of the step comprising said third portion and being at a lower height than the part of the said bottom rearward of the step.

6. A mounting stand according to claim 1 or claim 4, including a raised lip extending across the copy support surface at the lower end thereof for restraining copy materials on the copy support surface from sliding off.

7. A mounting stand according to claim 6, said lip being movable to vary its position relative to the copy support surface.

8. A mounting stand according to claim 1 or claim 4, said front and rear regions being open to permit the passage of cables therethrough to the keyboard and cathode ray tube devices.

9. A mounting stand according to claim 1 or claim 4, further comprising a guide means releasably and slidably mounted onto said mounting stand.

10. A mounting stand according to claim 9, wherein the said guide means comprises an elongated band adapted to extend across the copy support surface, and having depending lateral legs which straddle the copy support surface and engage the sides of the mounting stand.

11. A mounting stand according to claim 10, wherein at least one of said legs is flexibly joined to the said band such that said flexible leg is flexible outwardly under tension in order to provide engagement between said legs and the said sides of the mounting stand.

12. A mounting stand according to claim 11, wherein said guide means legs are angled from the ends of the band inwardly towards each other toward an engagement portion which engages the said sides of the mounting stand, and below which the legs turn outwardly away from the stand, and wherein the distance between said engagement portions in the natural, unflexed state of the guide means is less than the distance between said sides, such that when the guide means is mounted on the mounting stand, said engagement portions resiliently engage the said sides.

13. A mounting stand according to claim 1 or claim 4, including means for varying the height of the further support surface relative to the said first portion.

14. A work station for a cathode ray tube having a display screen and keyboard for the input of information to be displayed on the screen, comprising:

a mounting stand having first and second portions, the first portion having a front region located in a vertical plane and terminating at a first height, a back region generally parallel to the front and extending up to a height greater than the top of the front region, a copy support surface starting from the top of the front region and inclined upwardly to the top of the back region for holding copy material, said second portion comprising means defining a further support surface starting adjacent the said back region of the first portion and extending in a direction generally horizontal away from the first portion for holding a cathode ray tube device thereon such that its display screen is above said second height, a keyboard, separate and distinct from the stand, and removably located immediately in front of said front region such that the top of the back of the keyboard is approximately at said first height, a cathode ray tube display device, separate and distinct from the stand, and removably located on the further support surface at a height which places the display screen generally at the eye level of an operator located at a suitable position to operate the said keyboard, and the keyboard, the copy support surface and the display screen being positioned in line, front to back, with the copy support surface above the height of the keyboard and the display screen above the height of the copy support surface.

15. In a work station comprising a cathode ray tube device having a display screen and a keyboard for the input of information to be displayed on the screen, the improvement comprising:

a mounting stand having first and second portions, a first portion having a front region located in a vertical plane and terminating at a first height, a back region generally parallel to the front region and extending up to a height greater than the top of the front region, a copy support surface starting from the top of the front region and inclined upwardly to the top of the back region for holding copy material, said keyboard being separate and distinct from the said stand and removably located immediately in front of the said front region, the top of the back of the keyboard being approximately at said first height, the second portion comprising means for defining a further support surface starting adjacent the said back region of the first portion and extending in a direction generally horizontal away from the first portion, said cathode ray tube device being separate and distinct from the stand and removably located on said further support surface such that its display screen is above the said second height, the keyboard, the copy support surface and the display screen being positioned in line, front to back, with the copy support surface above the height of the keyboard and the display screen above the height of the copy support surface.

16. A work station according to claim 14 or claim 15, the said front region forming the front of the mounting stand and the keyboard being located immediately in front of said front region.

17. A work station according to claim 16, including a raised lip extending across the copy support surface at the lower end thereof for restraining copy materials on the copy support surface from sliding off.

18. A work station according to claim 14 or claim 15, including a third portion defining a front support surface starting from the bottom of the said front region and extending generally horizontally in a direction away from the said first portion so as to define the front support surface, and said keyboard being located on said front support surface.

19. A work station according to claim 18, wherein the bottom of the mounting stand includes a step between the said front region and the said back region, the front part of the bottom of the mounting stand forward of the step comprising said third portion and being at a lower height than the part of the said bottom rearward of the step.

20. A work station according to claim 14 or claim 15, further comprising a guide means releaseably and slidably mounted onto said mounting stand.

21. A work station according to claim 14 or claim 15, including means for varying the height of the further support surface relative to the said first portion.

* * * * *